US010342259B2

(12) United States Patent
Kobal et al.

(10) Patent No.: US 10,342,259 B2
(45) Date of Patent: Jul. 9, 2019

(54) FLAVOR DELIVERY SYSTEM

(71) Applicant: Altria Client Services LLC, Richmond, VA (US)

(72) Inventors: Gerd Kobal, Sandy Hook, VA (US); Srinivasan Janardhan, Glen Allen, VA (US); Ashok Solanky, Mechanicsville, VA (US); Charles Dendy, Ruther Glen, VA (US)

(73) Assignee: Altria Client Services LLC, Richmond, VA (US)

( * ) Notice: Subject to any disclaimer, the term of this patent is extended or adjusted under 35 U.S.C. 154(b) by 125 days.

(21) Appl. No.: 15/464,762

(22) Filed: Mar. 21, 2017

(65) Prior Publication Data

US 2018/0271140 A1 Sep. 27, 2018

(51) Int. Cl.

| | |
|---|---|
| ***A24F 47/00*** | (2006.01) |
| ***A24B 15/28*** | (2006.01) |
| ***A24D 3/06*** | (2006.01) |
| ***A24D 3/10*** | (2006.01) |
| ***A24F 3/00*** | (2006.01) |
| ***B43K 29/00*** | (2006.01) |
| ***A24B 13/00*** | (2006.01) |
| ***A24B 15/16*** | (2006.01) |
| ***B43K 23/08*** | (2006.01) |

(52) U.S. Cl.

CPC ..... *A24F 47/008* (2013.01); *A24B 13/00* (2013.01); *A24B 15/16* (2013.01); *A24B 15/283* (2013.01); *A24D 3/061* (2013.01); *A24D 3/10* (2013.01); *A24F 3/00* (2013.01); *B43K 23/08* (2013.01); *B43K 29/00* (2013.01)

(58) Field of Classification Search

CPC ..... A24F 47/008

See application file for complete search history.

(56) References Cited

U.S. PATENT DOCUMENTS

| | | | | |
|---|---|---|---|---|
| 3,603,319 | A * | 9/1971 | Badgett | A24D 3/14 131/274 |
| 4,083,372 | A * | 4/1978 | Boden | A24F 47/002 128/202.21 |
| 5,115,824 | A * | 5/1992 | Marshall | A24D 3/166 131/331 |
| 7,578,298 | B2 | 8/2009 | Karles et al. | |
| 7,878,962 | B2 | 2/2011 | Karles et al. | |
| 8,336,557 | B2 | 12/2012 | Kumar et al. | |

(Continued)

FOREIGN PATENT DOCUMENTS

| | | |
|---|---|---|
| CN | 204245155 U | 4/2015 |
| CN | 204273245 U | 4/2015 |

(Continued)

OTHER PUBLICATIONS

U.S. Appl. No. 15/135,923, filed Apr. 22, 2016.

(Continued)

*Primary Examiner* — James Harvey

(74) *Attorney, Agent, or Firm* — Harness, Dickey & Pierce, P.L.C.

(57) ABSTRACT

A flavor delivery system includes an oral tobacco product and a flavor inhalation article. The oral tobacco product includes tobacco and a first flavorant. The flavor inhalation article includes a body having an air flow channel therethrough, and a second flavorant.

36 Claims, 8 Drawing Sheets

(56) References Cited

U.S. PATENT DOCUMENTS

| | | | | |
|---|---|---|---|---|
| 8,469,036 | B2 | 6/2013 | Williams et al. | |
| 8,616,221 | B2 | 12/2013 | Torrence et al. | |
| 8,627,828 | B2 | 1/2014 | Strickland et al. | |
| 8,636,011 | B2 | 1/2014 | Strickland et al. | |
| 8,701,679 | B2 | 4/2014 | Crawford et al. | |
| 8,950,408 | B2 | 2/2015 | Chappell, Sr. et al. | |
| 9,032,971 | B2 | 5/2015 | Mishra et al. | |
| 9,126,704 | B2 | 9/2015 | Williams | |
| 9,289,014 | B2 | 3/2016 | Tucker et al. | |
| 9,289,104 | B2 | 3/2016 | Justus | |
| 2010/0170522 | A1* | 7/2010 | Sun | A24B 13/00 131/274 |
| 2013/0192623 | A1 | 8/2013 | Tucker et al. | |
| 2014/0130814 | A1 | 5/2014 | Gao et al. | |
| 2014/0166027 | A1 | 6/2014 | Fuisz et al. | |
| 2015/0027469 | A1* | 1/2015 | Tucker | A24F 47/008 131/329 |
| 2015/0101606 | A1* | 4/2015 | White | A61M 15/00 128/203.26 |
| 2015/0209530 | A1* | 7/2015 | White | A61M 11/042 424/729 |
| 2015/0264978 | A1 | 9/2015 | Arnel et al. | |
| 2015/0313282 | A1 | 11/2015 | Ademe et al. | |
| 2016/0095356 | A1* | 4/2016 | Chan | A24F 47/008 131/329 |
| 2016/0309785 | A1 | 10/2016 | Holtz | |
| 2016/0309786 | A1 | 10/2016 | Holtz et al. | |
| 2017/0258140 | A1* | 9/2017 | Rostami | A24F 47/008 |
| 2017/0265517 | A1* | 9/2017 | Swede | A24B 15/16 |
| 2017/0325502 | A1 | 11/2017 | Nelson et al. | |
| 2018/0271140 | A1* | 9/2018 | Kobal | A24B 15/283 |
| 2018/0295885 | A1* | 10/2018 | Rojo-Calderon | H05B 6/106 |
| 2018/0297048 | A1* | 10/2018 | Ricketts | A24F 47/008 |

FOREIGN PATENT DOCUMENTS

| | | | |
|---|---|---|---|
| CN | 204838002 | U | 12/2015 |
| CN | 205682426 | U | 11/2016 |
| FR | 2982527 | A1 | 5/2013 |

OTHER PUBLICATIONS

U.S. Appl. No. 15/154,439, filed May 13, 2016.
U.S. Appl. No. 15/135,930, filed Apr. 22, 2016.
International Search Report and Written Opinion for International Application No. PCT/EP2018/057212 dated Jun. 6, 2018.
Written Opinion for corresponding International Application No. PCT/EP2018/057212 dated Feb. 13, 2019.

* cited by examiner

FLAVOR DELIVERY SYSTEM

BACKGROUND

Field

The present disclosure relates to a flavor delivery system including an electronic vaping device (e-vaping device).

Description of Related Art

An e-vaping device includes a heater element which vaporizes a pre-vapor formulation to produce a "vapor."

The e-vaping device includes a power supply, such as a rechargeable battery, arranged in the device. The battery is electrically connected to the heater, such that the heater heats to a temperature sufficient to convert a pre-vapor formulation to a vapor. The vapor exits the e-vaping device through a mouthpiece including at least one outlet.

SUMMARY

At least one example embodiment relates to a flavor delivery system.

In at least one example embodiment, a flavor delivery system comprises an oral tobacco product and a flavor inhalation article. The oral tobacco product includes tobacco and a first flavorant. The flavor inhalation article includes a body having an air flow channel therethrough, and a second flavorant.

In at least one example embodiment, the oral tobacco product comprises at least one of: (a) moist smokeless tobacco, (b) a tobacco tablet, (c) snus, (d) a tobacco matrix, (e) a molded tobacco product, and (f) a tobacco bead.

In at least one example embodiment, the oral tobacco product further comprises at least one polymer. The oral tobacco product further comprises a coating. The oral tobacco product further comprises a binder.

In at least one example embodiment, the body of the flavor inhalation article comprises a porous substrate. The body of the flavor inhalation article comprises at least one plug of filter material and the second flavorant is contained in at least one frangible capsule. The at least one plug of filter material comprises cellulose acetate. The at least one plug of filter material comprises low efficiency filter material having a resistance-to-draw of about 50 mm $H_2O$ to about 150 mm $H_2O$.

In at least one example embodiment, the flavor inhalation article is an electronic vaping device. The electronic vaping device comprises: a heater; and a power supply configured to supply power to the heater.

In at least one example embodiment, the flavor inhalation article comprises: at least one ventilation hole; and a closing device configured to selectively open the at least one ventilation hole so as to allow air flow through the flavor inhalation device.

At least one example embodiment relates to an oral flavor article.

In at least one example embodiment, an oral flavor article comprises a housing. The housing includes a first compartment and a second compartment. The oral flavor article also includes an oral tobacco product removably contained in the first compartment. The oral tobacco product includes tobacco and a first flavorant. The oral flavor article also includes a flavor inhalation article. The flavor inhalation article is at least partially contained in the second compartment. The flavor inhalation article includes a body having an air flow channel therethrough and a second flavorant.

In at least one example embodiment, the housing forms part of a writing utensil.

In at least one example embodiment, the oral tobacco product comprises at least one of: (a) moist smokeless tobacco, (b) a tobacco tablet, (c) snus, (d) a tobacco matrix, (e) a molded tobacco product, and (f) a tobacco bead.

In at least one example embodiment, the oral tobacco product further comprises at least one polymer. The oral tobacco product further comprises a coating. The oral tobacco product further comprises a binder.

In at least one example embodiment, the body of the flavor inhalation article comprises a porous substrate. The body of the flavor inhalation article comprises at least one plug of filter material and the second flavorant is contained in at least one frangible capsule. The at least one plug of filter material comprises cellulose acetate. The at least one plug of filter material comprises low efficiency filter material having a resistance-to-draw of about 50 mm $H_2O$ to about 150 mm $H_2O$.

In at least one example embodiment, the flavor inhalation article is an electronic vaping device. The electronic vaping device comprises a heater and a power supply configured to supply power to the heater.

In at least one example embodiment, the flavor inhalation article comprises at least one ventilation hole and a closing device configured to selectively open the at least one ventilation hole so as to allow air flow through the flavor inhalation device.

At least one example embodiment relates to a flavor kit.

In at least one example embodiment, a flavor kit comprises an oral tobacco product and a flavor inhalation article. The oral tobacco product includes tobacco and a first flavorant. The flavor inhalation article includes a body having an air flow channel therethrough and a second flavorant.

In at least one example embodiment, the oral tobacco product comprises at least one of: (a) moist smokeless tobacco, (b) a tobacco tablet, (c) snus, (d) a tobacco matrix, (e) a molded tobacco product, and (f) a tobacco bead. The oral tobacco product further comprises at least one polymer. The oral tobacco product further comprises a coating. The oral tobacco product further comprises a binder.

In at least one example embodiment, the body of the flavor inhalation article comprises a porous substrate. The body of the flavor inhalation article comprises at least one plug of filter material and the second flavorant is contained in at least one frangible capsule.

In at least one example embodiment, the at least one plug of filter material comprises cellulose acetate. The at least one plug of filter material comprises low efficiency filter material having a resistance-to-draw of about 50 mm $H_2O$ to about 150 mm $H_2O$.

In at least one example embodiment, the flavor inhalation article is an electronic vaping device. The electronic vaping device comprises a heater and a power supply configured to supply power to the heater.

In at least one example embodiment, the flavor inhalation article comprises at least one ventilation hole and a closing device configured to selectively open the at least one ventilation hole so as to allow air flow through the flavor inhalation device.

At least one example embodiment relates to a method of enhancing oral enjoyment of an oral smokeless tobacco product.

In at least one example embodiment, a method of enhancing oral enjoyment of an oral smokeless tobacco product comprises pairing a smokeless oral tobacco product with a flavor inhalation article.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1:
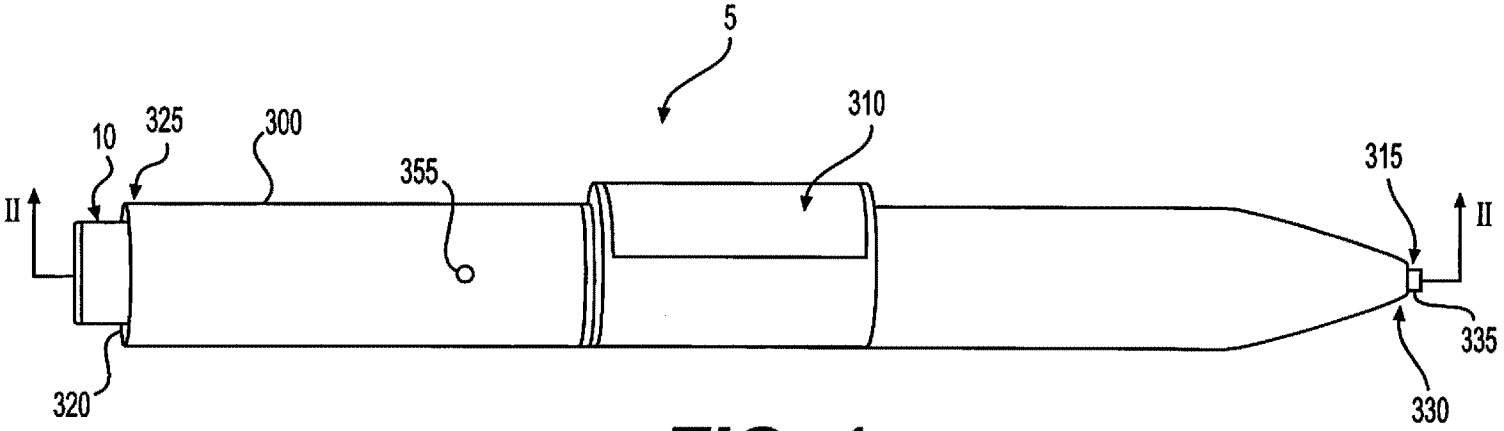
FIG. 1 is a side view of a flavor delivery system according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 1 is a side view of a flavor delivery system according to at least one example embodiment.

As shown in FIG. 1, the flavor delivery system 5 including a housing 300. The housing 300 is configured to hold an inhalation article 10 and a writing implement 315. The housing 300 may also include a compartment 310 that is sized and configured to store one or more oral products, such as oral tobacco products and/or oral non-tobacco products (shown in FIGS. 2 and 6-9 and discussed below).

In at least one example embodiment, the housing 300 is formed of a plastic and has a generally cylindrical cross-section. In other example embodiments, the cross-section of the housing 300 may have other shapes. A width and/or diameter of the housing 300 may be the same along a length thereof. In other example embodiments, the width and diameter of the housing 300 may vary along the length of the housing 300.

In at least one example embodiment, the housing 300 includes an opening 320 at a first end 325. The inhalation article 10 may be inserted and/or removed via the opening 320. The housing 300 may include a second opening 335 at a second end 330 of the housing. The writing implement 315 may be inserted and/or removed via the second opening 335.

In at least one example embodiment, the compartment 310 includes a lid configured to open and close so as to allow access to the compartment.

Figure 2:
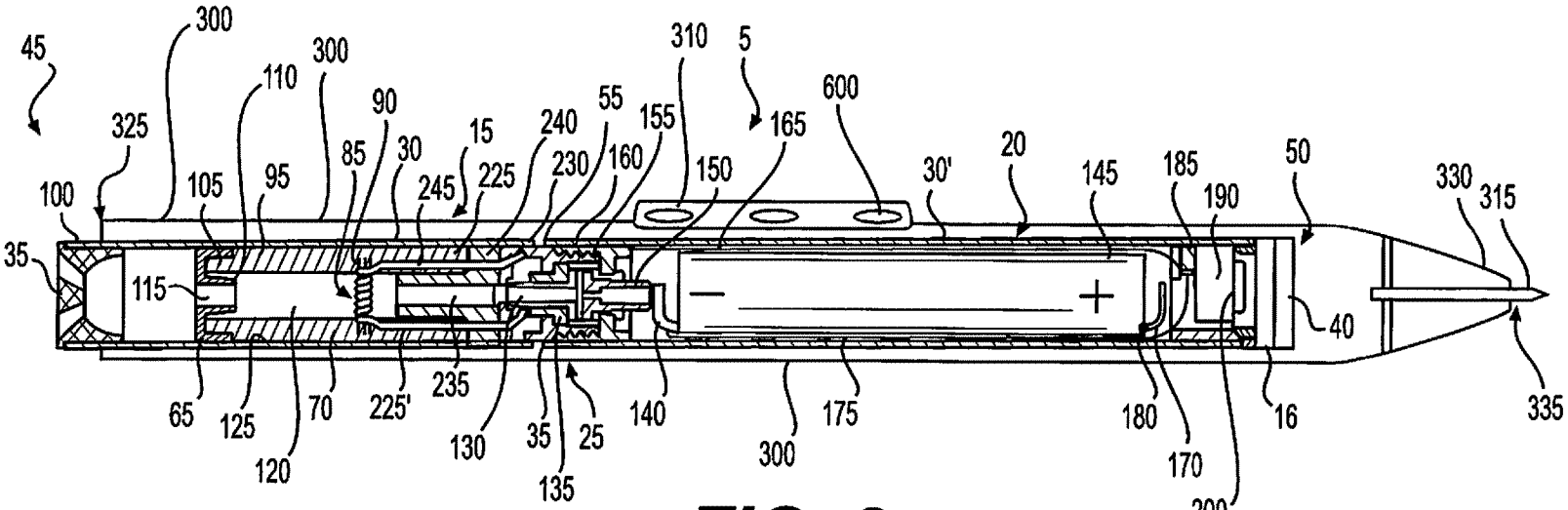
FIG. 2 is a cross-sectional view of the flavor delivery system of FIG. 1 along line II-II according to at least one example embodiment.

FIG. 2 is a cross-sectional view of the flavor delivery system of FIG. 1 along line II-II according to at least one example embodiment.

In at least one example embodiment, as shown in FIG. 2, the inhalation article 10 is in the form of an electronic vaping device, which is contained in the housing 300 of the flavor delivery system 5.

In at least one example embodiment, as shown in FIG. 1, the electronic vaping device (inhalation article) 10 may include a replaceable cartridge (or first section) 15 and a reusable battery section (or second section) 20, which may be coupled together at a threaded connector 25. It should be appreciated that the connector 25 may be any type of connector, such as a snug-fit, detent, clamp, bayonet, and/or clasp. An air inlet 55 extends through a portion of the connector 25 and is in communication with the air inlet 55 in the flavor delivery system housing 300.

In at least one example embodiment, the connector 25 may be the connector described in U.S. application Ser. No. 15/154,439, filed May 13, 2016, the entire contents of which is incorporated herein by reference thereto. As described in U.S. application Ser. No. 15/154,439, the connector 25 may be formed by a deep drawn process.

In at least one example embodiment, the first section 15 may include a first housing 30 and the second section 20 may include a second housing 30'. The e-vaping device 10 includes a mouth-end insert 35 at a first end 45.

In at least one example embodiment, the first housing 30 and the second housing 30' may have a generally cylindrical cross-section. In other example embodiments, the housings 30 and 30' may have a generally triangular cross-section along one or more of the first section 15 and the second section 20. Furthermore, the housings 30 and 30' may have the same or different cross-section shape, or the same or different size. As discussed herein, the housings 30, 30' may also be referred to as outer or main housings.

In at least one example embodiment, the e-vaping device 10 may include an end cap 40 at a second end 50 of the e-vaping device 10. The e-vaping device 10 also includes a light 60 between the end cap 40 and the first end 45 of the e-vaping device 10.

The first section 15 may include a reservoir 95 configured to store a pre-vapor formulation and a vaporizer 80 that may vaporize the pre-vapor formulation. The vaporizer 80 includes a heating element 85 and a wick 90. The wick 90 may draw the pre-vapor formulation from the reservoir 95. The e-vaping device 10 may include the features set forth in U.S. Patent Application Publication No. 2013/0192623 to Tucker et al. filed Jan. 31, 2013 and/or features set forth in U.S. patent application Ser. No. 15/135,930 to Holtz et al. filed Apr. 22, 2016, the entire contents of each of which are incorporated herein by reference thereto. In other example embodiments, the e-vaping device may include the features set forth in U.S. patent application Ser. No. 15/135,923 filed Apr. 22, 2016, and/or U.S. Pat. No. 9,289,014 issued Mar. 22, 2016, the entire contents of each of which is incorporated herein by this reference thereto.

In at least one example embodiment, the pre-vapor formulation is a material or combination of materials that may be transformed into a vapor. For example, the pre-vapor formulation may be a liquid, solid and/or gel formulation including, but not limited to, water, beads, solvents, active ingredients, ethanol, plant extracts, natural or artificial flavors, and/or vapor formers such as glycerin and propylene glycol.

In at least one example embodiment, the first section 15 may include the housing 30 extending in a longitudinal direction and an inner tube (or chimney) 70 coaxially positioned within the housing 30.

In at least one example embodiment, a first connector piece 155 may include a male threaded section for effecting the connection between the first section 15 and the second section 20.

At an upstream end portion of the inner tube 70, a nose portion 245 of a gasket (or seal) 240 may be fitted into the inner tube 70; and an outer perimeter of the gasket 240 may provide a seal with an interior surface of the housing 30. The gasket 240 may also include a central, longitudinal air passage 235 in fluid communication with the inner tube 70 to define an inner passage (also referred to as a central channel or central inner passage) 120. A transverse channel 230 at a backside portion of the gasket 240 may intersect and communicate with the air passage 235 of the gasket 240. This transverse channel 230 assures communication between the air passage 235 and a space 250 defined between the gasket 240 and the first connector piece 155.

In at least one example embodiment, the first connector piece 155 may include a male threaded section for effecting the connection between the first section 15 and the second section 20.

In at least one example embodiment, at least two air inlets 55 may be included in the housing 30. Alternatively, a single air inlet 55 may be included in the housing 30. Such an arrangement allows for placement of the air inlet 55 close to the connector 25 without occlusion by the presence of the first connector piece 155. This arrangement may also reinforce the area of air inlets 55 to facilitate precise drilling of the air inlets 55.

In at least one example embodiment, the air inlets 55 may be provided in the connector 25 instead of in the housing 30. In other example embodiments, the connector 25 may not include threaded portions.

In at least one example embodiment, the at least one air inlet 55 may be formed in the housing 30, adjacent the connector 25 to minimize the chance of an adult vaper's fingers occluding one of the ports and to control the resistance-to-draw (RTD) during vaping. In at least one example embodiment, the air inlet 55 may be machined into the housing 30 with precision tooling such that their diameters are closely controlled and replicated from one e-vaping device 10 to the next during manufacture.

In at least one example embodiment, the air inlets 55 may be sized and configured such that the e-vaping device 10 has a resistance-to-draw (RTD) in the range of from about 60 mm $H_2O$ to about 150 mm $H_2O$.

In at least one example embodiment, a nose portion 110 of a gasket 65 may be fitted into a first end portion 105 of the inner tube 70. An outer perimeter of the gasket 65 may provide a substantially tight seal with an interior surface 125 of the housing 30. The gasket 65 may include a central channel 115 disposed between the inner passage 120 of the inner tube 70 and the interior of the mouth-end insert 35, which may transport the vapor from the inner passage 120 to the mouth-end insert 35. The mouth-end insert 35 includes at least two outlets 100, which may be located off-axis from the longitudinal axis of the e-vaping device 10. The outlets 100 may be angled outwardly in relation to the longitudinal axis of the e-vaping device 10. The outlets 100 may be substantially uniformly distributed about the perimeter of the mouth-end insert 35 so as to substantially uniformly distribute vapor.

In at least one example embodiment, the space defined between the gasket 65, the gasket 240, the housing 30, and the inner tube 70 may establish the confines of the reservoir 95. The reservoir 95 may contain a pre-vapor formulation, and optionally a storage medium (not shown) configured to store the pre-vapor formulation therein. The storage medium may include a winding of cotton gauze or other fibrous material about the inner tube 70.

In at least one example embodiment, the reservoir 95 may at least partially surround the inner passage 120. Thus, the reservoir 95 may at least partially surround the inner passage 120. The heating element 85 may extend transversely across the inner passage 120 between opposing portions of the reservoir 95. In some example embodiments, the heater 85 may extend parallel to a longitudinal axis of the inner passage 120.

In at least one example embodiment, the reservoir 95 may be sized and configured to hold enough pre-vapor formulation such that the e-vaping device 10 may be configured for vaping for at least about 200 seconds. Moreover, the e-vaping device 10 may be configured to allow each puff to last a maximum of about 5 seconds.

In at least one example embodiment, the storage medium may be a fibrous material including at least one of cotton, polyethylene, polyester, rayon and combinations thereof. The fibers may have a diameter ranging in size from about 6 microns to about 15 microns (e.g., about 8 microns to about 12 microns or about 9 microns to about 11 microns). The storage medium may be a sintered, porous or foamed material. Also, the fibers may be sized to be irrespirable and may have a cross-section which has a Y-shape, cross shape, clover shape or any other suitable shape. In at least one example embodiment, the reservoir 95 may include a filled tank lacking any storage medium and containing only pre-vapor formulation.

During vaping, pre-vapor formulation may be transferred from the reservoir 95 and/or storage medium to the proximity of the heating element 85 via capillary action of the wick 90. The wick 90 may include at least a first end portion and a second end portion, which may extend into opposite sides of the reservoir 95. The heating element 85 may at least partially surround a central portion of the wick 90 such that when the heating element 85 is activated, the pre-vapor formulation in the central portion of the wick 90 may be vaporized by the heating element 85 to form a vapor.

In at least one example embodiment, the wick 90 may include filaments (or threads) having a capacity to draw the pre-vapor formulation. For example, the wick 90 may be a bundle of glass (or ceramic) filaments, a bundle including a group of windings of glass filaments, etc., all of which arrangements may be capable of drawing pre-vapor formulation via capillary action by interstitial spacings between the filaments. The filaments may be generally aligned in a direction perpendicular (transverse) to the longitudinal direction of the e-vaping device 10. In at least one example embodiment, the wick 90 may include one to eight filament strands, each strand comprising a plurality of glass filaments twisted together. The end portions of the wick 90 may be flexible and foldable into the confines of the reservoir 95. The filaments may have a cross-section that is generally cross-shaped, clover-shaped, Y-shaped, or in any other suitable shape.

In at least one example embodiment, the wick 90 may include any suitable material or combination of materials. Examples of suitable materials may be, but not limited to, glass, ceramic- or graphite-based materials. The wick 90 may have any suitable capillarity drawing action to accommodate pre-vapor formulations having different physical properties such as density, viscosity, surface tension and vapor pressure. The wick 90 may be non-conductive.

In at least one example embodiment, the heating element 85 may include a wire coil which at least partially surrounds the wick 90. The wire may be a metal wire and/or the heater coil may extend fully or partially along the length of the wick 90. The heater coil may further extend fully or partially around the circumference of the wick 90. In some example embodiments, the heating element 85 may or may not be in contact with the wick 90.

In at least one example embodiment, the heater coil may be formed of any suitable electrically resistive materials. Examples of suitable electrically resistive materials may include, but not limited to, copper, titanium, zirconium, tantalum and metals from the platinum group. Examples of suitable metal alloys include, but not limited to, stainless steel, nickel, cobalt, chromium, aluminum-titanium-zirconium, hafnium, niobium, molybdenum, tantalum, tungsten, tin, gallium, manganese and iron-containing alloys, and super-alloys based on nickel, iron, cobalt, stainless steel. For example, the heating element 85 may be formed of nickel aluminide, a material with a layer of alumina the surface, iron aluminide and other composite materials, the electrically resistive material may optionally be embedded in, encapsulated or coated with an insulating material or vice-versa, depending on the kinetics of energy transfer and the external physicochemical properties required. The heating element 85 may include at least one material selected from the group consisting of stainless steel, copper, copper alloys, nickel-chromium alloys, super alloys and combinations thereof. In an example embodiment, the heating element 85 may be formed of nickel-chromium alloys or iron-chromium alloys. In another example embodiment, the heating element 85 may be a ceramic heater having an electrically resistive layer on an outside surface thereof.

In other example embodiments, the heating element 85 may be in the form of a heater plate, a spiral, a tube, or any other suitable shape.

The inner tube 70 may include a pair of opposing slots, such that the wick 90 and the first and second electrical leads 225, 225' or ends of the heating element 85 may extend out from the respective opposing slots. The provision of the opposing slots in the inner tube 70 may facilitate placement of the heating element 85 and wick 90 into position within the inner tube 70 without impacting edges of the slots and the coiled section of the heating element 85. Accordingly, edges of the slots may not be allowed to impact and alter the coil spacing of the heating element 85, which would otherwise create potential sources of hotspots. In at least one example embodiment, the inner tube 70 may have a diameter of about 4 mm and each of the opposing slots may have major and minor dimensions of about 2 mm by about 4 mm.

In at least one example embodiment, the first lead 225 is physically and electrically connected to the male threaded connector piece 155. As shown, the male threaded first connector piece 155 is a hollow cylinder with male threads on a portion of the outer lateral surface. The connector piece is conductive, and may be formed or coated with a conductive material. The second lead 225' is physically and electrically connected to a first conductive post 130. The first conductive post 130 may be formed of a conductive material (e.g., stainless steel, copper, etc.), and may have a T-shaped cross-section as shown in FIG. 2. The first conductive post 130 nests within the hollow portion of the first connector piece 155, and is electrically insulated from the first connector piece 155 by an insulating shell 135. The first conductive post 130 may be hollow as shown, and the hollow portion may be in fluid communication with the air passage 120. Accordingly, the first connector piece 155 and the first conductive post 130 form respective external electrical connection to the heating element 85.

In at least one example embodiment, the heating element 85 may heat pre-vapor formulation in the wick 90 by thermal conduction. Alternatively, heat from the heating element 85 may be conducted to the pre-vapor formulation by means of a heat conductive element or the heating element 85 may transfer heat to the incoming ambient air that is drawn through the e-vaping device 10 during vaping, which in turn heats the pre-vapor formulation by convection.

It should be appreciated that, instead of using a wick 90, the heating element 85 may include a porous material which incorporates a resistance heater formed of a material having a high electrical resistance capable of generating heat quickly.

As shown in FIG. 2, the second section 20 includes a power supply 145, a control circuit 185, and a sensor 190. As shown, the control circuit 185 and the sensor 190 are disposed in the housing 30'. A female threaded second connector piece 160 forms a second end. As shown, the second connector piece 160 has a hollow cylinder shape with threading on an inner lateral surface. The inner diameter of the second connector piece 160 matches that of the outer diameter of the first connector piece 155 such that the two connector pieces 155, 160 may be threaded together to form the connection 25. Furthermore, the second connector piece 160, or at least the outer lateral surface is conductive, for example, formed of or including a conductive material. As such, an electrical and physical connection occurs between the first and second connector pieces 155, 160 when connected.

As shown, a first lead 165 electrically connects the second connector piece 160 to the control circuit 185. A second lead 170 electrically connects the control circuit 185 to a first terminal 180 of the power supply 145. A third lead 175 electrically connects a second terminal 140 of the power supply 145 to the power terminal of the control circuit 185 to provide power to the control circuit 185. The second terminal 140 of the power supply 145 is also physically and electrically connected to a second conductive post 150. The second conductive post 150 may be formed of a conductive material (e.g., stainless steel, copper, etc.), and may have a T-shaped cross-section as shown in FIG. 2. The second conductive post 150 nests within the hollow portion of the second connector piece 160, and is electrically insulated from the second connector piece 160 by a second insulating shell 215. The second conductive post 150 may also be hollow as shown. When the first and second connector pieces 155, 160 are mated, the second conductive post 150 physically and electrically connects to the first conductive post 130. Also, the hollow portion of the second conductive post 150 may be in fluid communication with the hollow portion of the first conductive post 130.

While the first section 15 has been shown and described as having the male connector piece and the second section 20 has been shown and described as having the female connector piece, an alternative embodiment includes the opposite where the first section 15 has the female connector piece and the second section 20 has the male connector piece.

In at least one example embodiment, the power supply 145 includes a battery arranged in the e-vaping device 10. The power supply 145 may be a Lithium-ion battery or one of its variants, for example a Lithium-ion polymer battery. Alternatively, the power supply 145 may be a nickel-metal hydride battery, a nickel cadmium battery, a lithium-manganese battery, a lithium-cobalt battery or a fuel cell. The e-vaping device 10 may be vapable by an adult vaper until the energy in the power supply 145 is depleted or in the case of lithium polymer battery, a minimum voltage cut-off level is achieved.

In at least one example embodiment, the power supply 145 is rechargeable. The second section 20 may include circuitry configured to allow the battery to be chargeable by an external charging device. To recharge the e-vaping device 10, an USB charger or other suitable charger assembly may be used as described below.

In at least one example embodiment, the sensor 190 is configured to generate an output indicative of a magnitude and direction of airflow in the e-vaping device 10. The control circuit 185 receives the output of the sensor 190, and determines if (1) the direction of the airflow indicates a draw on the mouth-end insert 8 (versus blowing) and (2) the magnitude of the draw exceeds a threshold level. If these vaping conditions are met, the control circuit 185 electrically connects the power supply 145 to the heating element 85; thus, activating the heating element 85. Namely, the control circuit 185 electrically connects the first and second leads 165, 170 (e.g., by activating a heater power control transistor forming part of the control circuit 185) such that the heating element 85 becomes electrically connected to the power supply 145. In an alternative embodiment, the sensor 190 may indicate a pressure drop, and the control circuit 185 activates the heating element 85 in response thereto.

In at least one example embodiment, the control circuit 185 may also include a light 60, which the control circuit 185 activates to glow when the heating element 85 is activated and/or the battery 145 is recharged. The light 60 may include one or more light-emitting diodes (LEDs). The LEDs may include one or more colors (e.g., white, yellow, red, green, blue, etc.). Moreover, the light 60 may be arranged to be visible to an adult vaper during vaping, and may be positioned between the first end 45 and the second end 50 of the e-vaping device 10. In addition, the light 60 may be utilized for e-vaping system diagnostics or to indicate that recharging is in progress. The light 60 may also be configured such that the adult vaper may activate and/or deactivate the heater activation light 60 for privacy.

In at least one example embodiment, the control circuit 185 may include a time-period limiter. In another example embodiment, the control circuit 185 may include a manually operable switch for an adult vapor to initiate heating. The time-period of the electric current supply to the heating element 85 may be set or pre-set depending on the amount of pre-vapor formulation desired to be vaporized.

Next, operation of the e-vaping device to create a vapor will be described. For example, air is drawn primarily into the first section 15 through the at least one air inlet 55 in response to a draw on the mouth-end insert 35. The air passes through the air inlet 55, into the space 250, through the transverse channel 230 into the air passage 235, into the inner passage 120, and through the outlet 100 of the mouth-end insert 35. If the control circuit 185 detects the vaping conditions as discussed above, the control circuit 185 initiates power supply to the heating element 85, such that the heating element 85 heats pre-vapor formulation in the wick 90. The vapor and air flowing through the inner passage 120 combine and exit the e-vaping device 10 via the outlet 100 of the mouth-end insert 35.

When activated, the heating element 85 may heat a portion of the wick 90 for less than about 10 seconds.

In at least one example embodiment, the first section 15 may be replaceable. In other words, once the pre-vapor formulation of the cartridge is depleted, only the first section 15 may be replaced. An alternate arrangement may include an example embodiment where the entire e-vaping device 10 may be disposed once the reservoir 95 is depleted. In at least one example embodiment, the e-vaping device 10 may be a one-piece e-vaping device.

In at least one example embodiment, the e-vaping device 10 may be about 80 mm to about 110 mm long and about 7 mm to about 8 mm in diameter. For example, in one example embodiment, the e-vaping device 10 may be about 84 mm long and may have a diameter of about 7.8 mm.

In at least one example embodiment, as shown in FIG. 2, the housing 300 of the flavor delivery system 5 includes the compartment 310. The compartment 310 is configured to contain one or more oral tobacco products 600. The compartment 310 may include a hinged lid (not shown), such that an adult consumer may access the compartment 310 to insert or remove the oral tobacco product 600 therefrom.

In at least one example embodiment, the inhalation article 10 has a same or different flavor than the oral products 600. The flavor of the inhalation article 10 may complement and/or contrast the flavor of the oral products 600.

In at least one example embodiment, one or more of the inhalation article 10 and the oral products 600 are nicotine free. In other example embodiments, the oral products 600 may include nicotine and the inhalation article 10 may not include nicotine.

In at least one example embodiment, the writing implement 315 is a pencil. In other example embodiments, the pencil may be replaced with a stylus, pen, or other device and/or writing implement.

Figure 3:
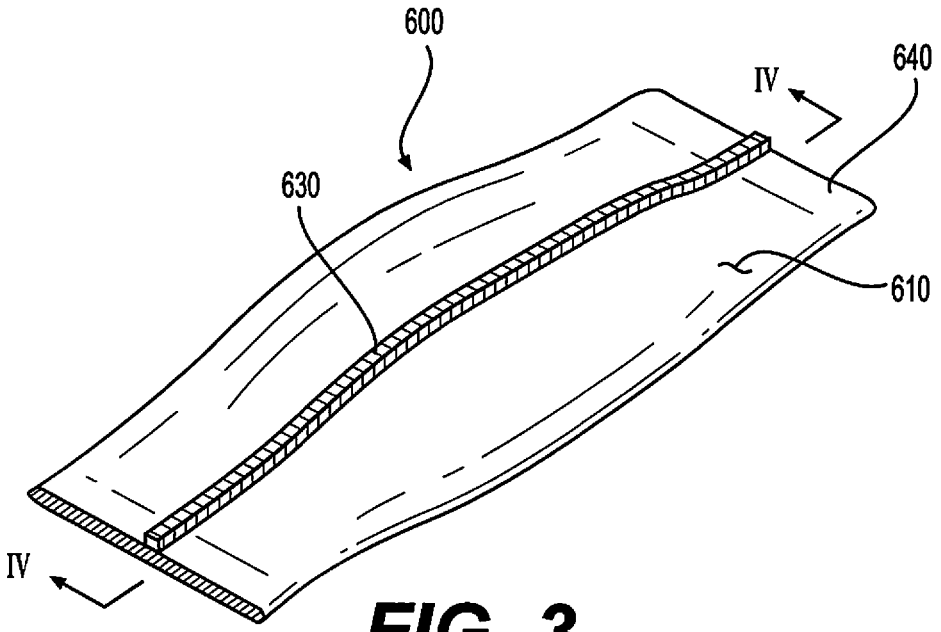
FIG. 3 is a perspective view of an oral tobacco product in the form of an oral pouch product for use in a flavor delivery system according to at least one example embodiment.

FIG. 3 is a perspective view of an oral tobacco product in the form of an oral pouch product for use in a flavor delivery system according to at least one example embodiment.

In at least one example embodiment, as shown in FIG. 3, the oral tobacco product 600 that is contained in the compartment 310 of the flavor delivery system 5 is an oral pouch product. The oral pouch product includes a pouch wrapper 610 and an inner filling material 620 (shown in FIG. 4) within the pouch wrapper 610. The pouch wrapper 610 may include one or more fin and/or lap seals 630, 640. The oral pouch product may include the features of the pouch product described in U.S. Pat. No. 9,126,704 issued Sep. 8, 2015 to Williams, U.S. Pat. No. 8,616,221 issued Dec. 31, 2013 to Torrence et al., U.S. Pat. No. 8,950,408 issued Feb. 10, 2015 to Chappell, Sr. et al., and/or U.S. Pat. No. 8,701,679 issued Apr. 22, 2014 to Crawford et al. the entire contents of each of which is incorporated herein by reference thereto.

Figure 4:
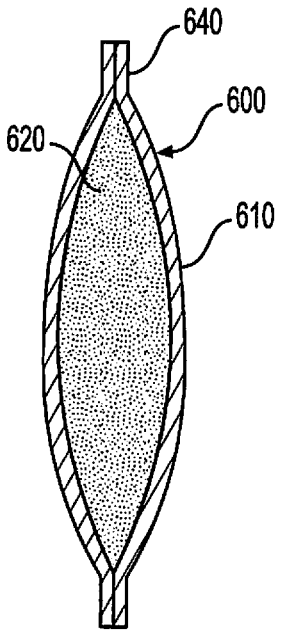
FIG. 4 is a cross-sectional view of the oral tobacco product of FIG. 3 along line IV-IV according to at least one example embodiment.

FIG. 4 is a cross-sectional view of the oral tobacco product of FIG. 3 along line IV-IV according to at least one example embodiment.

In at least one example embodiment, as shown in FIG. 4, the oral pouch product is the same as shown in FIG. 3, but the inner filling material 620 within the pouch wrapper 610 is shown.

Figure 5:
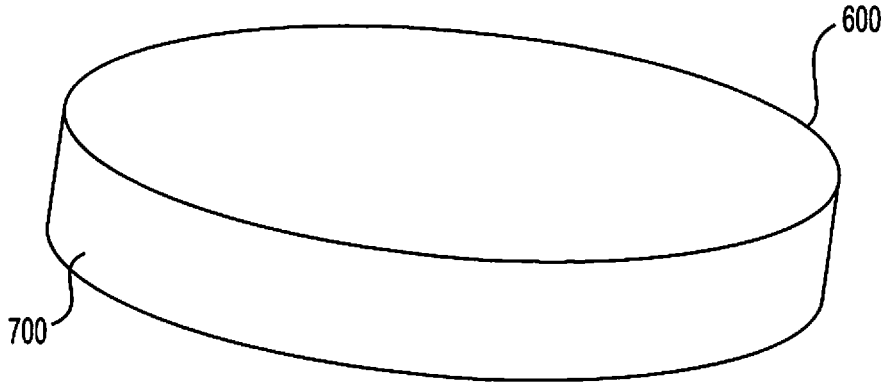
FIG. 5 is a perspective view of an oral tobacco product in the form of a tablet for use in a flavor delivery system according to at least one example embodiment.

FIG. 5 is a perspective view of an oral tobacco product in the form of a tablet for use in a flavor delivery system according to at least one example embodiment.

In at least one example embodiment, as shown in FIG. 5, the oral tobacco product 600 may be a tablet 700, such as a tablet of compressed tobacco powder. The tablet 700 can be contained in the compartment 310 described above. The tablet 700 may have the features of the tablets described in U.S. Pat. No. 8,336,557 issued Dec. 25, 2012 to Kumar et al., the entire content of which is incorporated herein by reference thereto.

Figure 6:
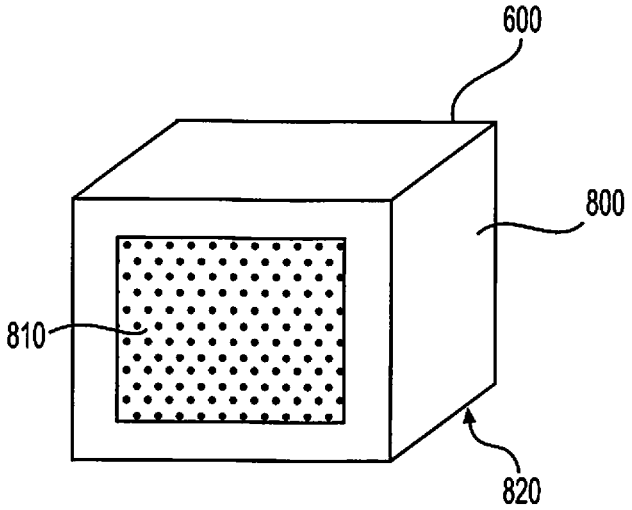
FIG. 6 is a perspective view of an oral tobacco product in the form of a gel-coated, moist tobacco product for use in a flavor delivery system according to at least one example embodiment.

FIG. 6 is a perspective view of an oral tobacco product in the form of a gel-coated, moist tobacco product for use in a flavor delivery system according to at least one example embodiment.

In at least one example embodiment, as shown in FIG. 6, the oral tobacco product 600 may be a moist tobacco product 820 including a molded portion of tobacco material 810 and having a coating 800 thereon. The moist tobacco product 820 may be contained in the compartment 310 (Shown in FIG. 2). The moist tobacco product 820 may have the features described in U.S. Pat. No. 9,032,971 issued May 19, 2015 to Mishra et al., the entire content of which is incorporated herein by reference thereto.

In other example embodiments, the flavor system may include an oral non-tobacco product in lieu of the oral tobacco product. In other example embodiments, the oral tobacco product and/or the oral non-tobacco product may be in the form of a bead, a capsule, a film, a chew, a stick, or any other suitable form. For example, the oral tobacco product and/or the oral non-tobacco product may include the features of the products set forth in U.S. Pat. No. 8,469,036 issued Jun. 25, 2013 to Williams et al., U.S. Pat. No. 8,627,828 issued Jan. 14, 2014 to Strickland et al. and/or U.S. Pat. No. 8,636,011 issued Jan. 28, 2014 to Strickland et al., the entire contents of each of which is incorporated herein by reference thereto.

Figure 7:
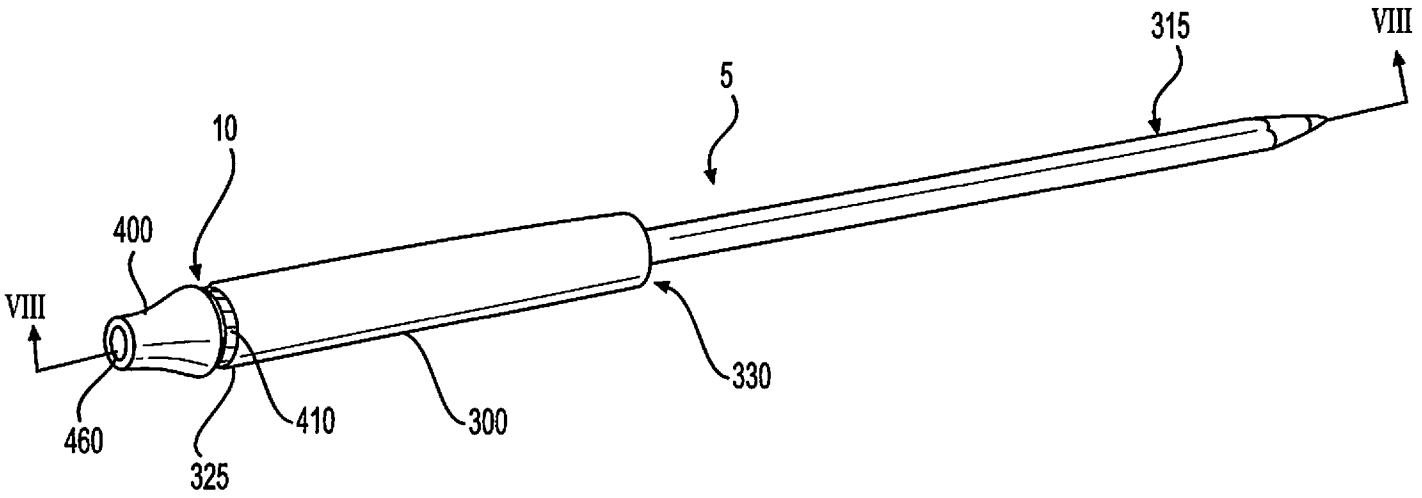
FIG. 7 is a perspective view of a flavor inhalation article according to at least one example embodiment.

FIG. 7 is a perspective view of a flavor delivery system according to at least one example embodiment.

In at least one example embodiment, as shown in FIG. 7, the inhalation article 10 includes a flavor tube 410 (shown in FIGS. 8A and 8B), instead of the electronic vaping device of FIGS. 1 and 2, and the writing implement 315 is a pencil. In other example embodiments, the pencil may be replaced with a stylus, pen, or other device and/or writing implement.

In at least one example embodiment, the flavor tube 410 includes a mouthpiece 400. When the flavor tube 410 is inserted into the housing 300, the mouthpiece 400 extends from the first end 325 of the housing 300.

Figure 8A:
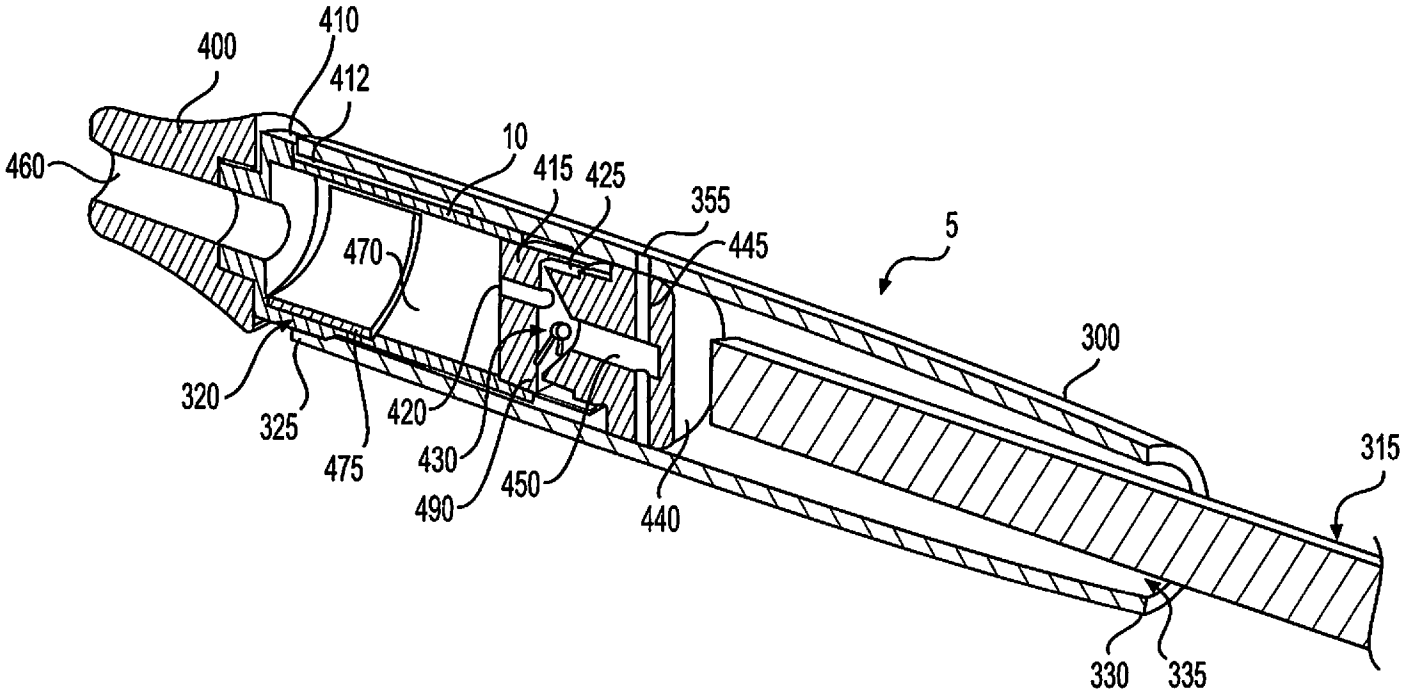
FIGS. 8A and 8B are perspective, cross-sectional views of the flavor inhalation article of FIG. 7 along line according to at least one example embodiment.
Figure 8B:
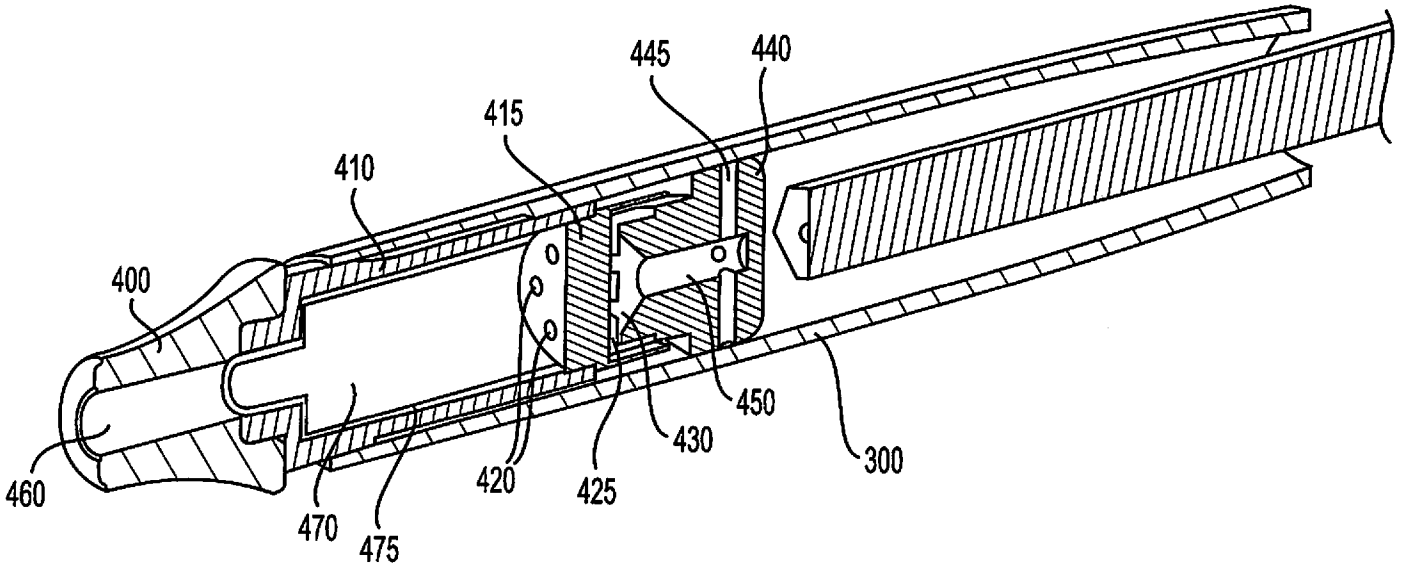

FIGS. 8A and 8B are perspective, cross-sectional views of the flavor inhalation article of FIG. 7 along line VIII-VIII according to at least one example embodiment.

In at least one example embodiment, as shown in FIG. 8A, the flavor tube includes a tube 412 defining a hollow section 470. An additive material may be included as a coating 475 on at least one surface of the tube 412. In other example embodiments, the additive material may be embedded in the tube 412. As air flows through the hollow section 470 of the tube 412, portions of the additive material become entrained in the air flow.

In at least one example embodiment, the tube 412 is formed of an absorbent material, such as a porous foam, a ceramic, a gauze, a cotton, or a cellulosic material. For example, the tube 412 may be formed of a filter material, such as cellulose acetate.

In at least one example embodiment, the tube 412 is impregnated with and/or coated with the additive material. The additive material may include any of the ingredients included in the pre-vapor formulation described above. In at least one example embodiment, the additive material may include only propylene glycol and flavor so as to produce a vapor that is substantially invisible.

In at least one example embodiment, the tube 412 includes the mouthpiece 400 attached thereto. The mouthpiece 400 includes an outlet 460 extending therethrough. The outlet 460 is in fluid communication with the hollow section 470. An inner diameter of the outlet 460 may be adjusted to alter a resistance-to-draw (RTD) of the flavor inhalation article 10. In some example embodiments, the mouthpiece 400 includes multiple outlets.

In at least one example embodiment, a gasket 415 including at least one air channel 420 is mated with a second end of the tube 412. The gasket 415 may include at least one air channel 420 (e.g., at least two, at least three, at least four, at least five, at least six, at least seven, at least eight, at least nine, or at least ten) defined therein. The at least one air channel 420 extends longitudinally through the gasket 415. For example, the gasket 415 may include two to ten spaced air channels 420 (e.g., three to nine, four to eight, five to seven, or six). The air channels 420 may be substantially uniformly spaced or non-uniformly spaced.

The gasket 415 forms part of an airflow control portion 490, which also includes a fixed body 425 that abuts the gasket 415 as described in detail below with respect to FIGS. 8C and 8D. The fixed body 425 defines a plurality of air passages 430. The gasket 415, the tube 412, and the mouthpiece 440 are moveable with respect to the fixed body 425, such that the air channels 420 of the gasket 415 selectively align with the air passages 430 of the fixed body 425 to alter an amount of ventilation and to seal the tube 410 when the inhalation article 10 is stored as described in more detail below.

In at least one example embodiment, a base 440 abuts and/or is connected to the fixed body 425. The fixed body 425 is cup-shaped and includes a side wall 428 that receives a portion of the base 440.

In some example embodiments, the fixed body 425 may be removably connected to the base 440.

In at least one example embodiment, the base 440 forms an end portion of the inhalation article 10. The base 440 may be friction fitted within the housing 300 of the flavor delivery system 5. The base 440 may be adhered to an inner surface of the housing 300 so that the base 440 does not rotate with respect to the housing 300.

In at least one example embodiment, the base 440 is generally cylindrical and includes air inlets 445 defined therein. The air inlets 445 extend transverse to a longitudinal direction. The air inlets 445 are in fluid communication with at least one air inlet 355 in the housing 300. The air inlets 445 are also in fluid communication with a central air passage 450 defined in the body 440. The central air passage 450 extends in the longitudinal direction through the base 440. The central air passage 450 is substantially perpendicular to the air inlets 445. The central air passage 450 is in fluid communication with the air passages 430 of the disc 425, such that when air is drawn into the inhalation article via the air inlets 445, the air flows into the central air passage 450, through the air passage 430, through the air channel 420, and into the hollow section 470 of the tube 410.

Figure 8C:
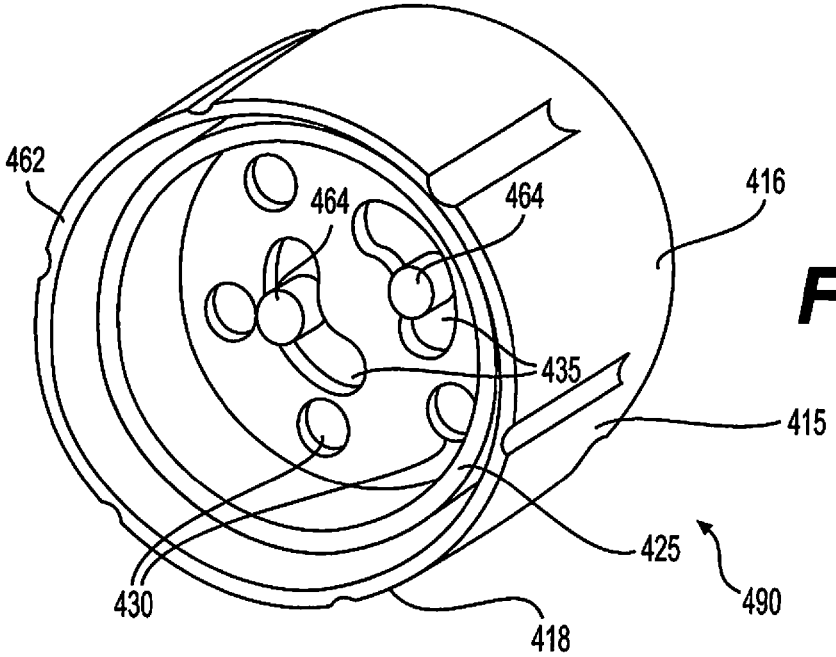
FIGS. 8C and 8D are perspective views of an airflow control portion of the flavor inhalation article of FIGS. 7, 8A, and 8B according to at least one example embodiment.
Figure 8D:
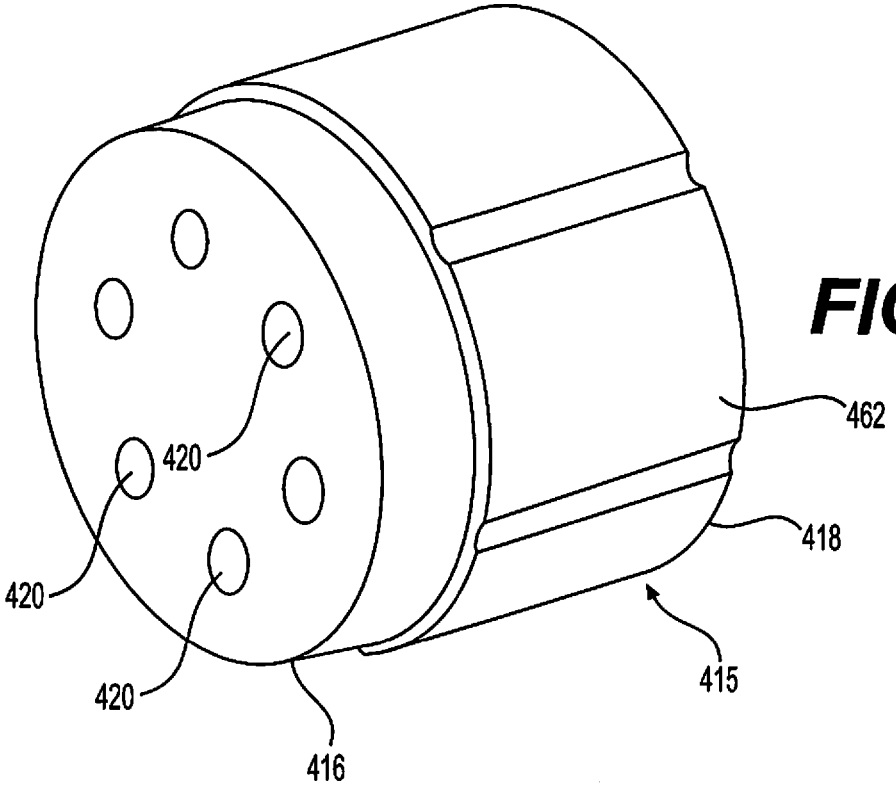

FIGS. 8C and 8D are perspective views of an airflow control portion of the flavor inhalation article of FIGS. 7, 8A, and 8B according to at least one example embodiment.

In at least one example embodiment as shown in FIGS. 8C and 8D, the gasket 415 is generally cup-shaped. The gasket 415 has a generally planar end surface at a first end 416, and a side wall 462 defining a tubular portion at a second end 418 of the gasket 415. The side wall 462 has a smaller outer diameter at the first end 416, such that the tube 412 can fit around a portion of the side wall 462. The side wall 462 has a larger diameter at the second end 418, such that the fixed body 425 and a portion of the base 440 are received within the side wall 462 of the gasket 415.

The gasket 415 includes at least two pegs 464 extending longitudinally from a surface of the gasket 415. The fixed body 425 includes cutouts 435 that are arcuate in shape. Each peg 464 is received within one of the cutouts 435 when the fixed body 425 is placed within the side wall 462 of the gasket 415. The air passages 430 of the fixed body 425 can be aligned with the air channels 420 of the gasket by rotating the gasket 415 with respect to the fixed body 425. During rotation of the gasket 415, the pegs 464 stay within the arcuate cutouts 434 and maintain the fixed body 425 in position relative to the gasket 415. When the pegs 464 are at one end of the arcuate cutouts 434, all of the air passages 430 are aligned with one of the air channels 420. When the pegs 464 are at a second end of the arcuate cutouts 434, all of the air passages are not aligned with the air channels 420 so as to shut off airflow therethrough. When the pegs 464 are between the ends of the arcuate cutouts 434, the air passages 430 are in partial fluid communication with ones of the air channels 420.

In at least one example embodiment, the gasket 415, the fixed body 425, and the base 440 may be formed of a plastic that has a substantially smooth surface so as to ensure ease of rotation of the gasket 415 with respect to the fixed body 425. The plastic may be polyethylene, polypropylene, and/or any other suitable plastic. The gasket 415, the fixed body 425, and the base 440 may be injection molded.

To alter the level of ventilation and/or air flow through the inhalation article 10, an adult vaper may twist the mouthpiece 400, which causes the tube 410 and the gasket 415 to rotate in relation to the fixed body 425. The gasket 415 may then block one or more of the air passages 430 in the fixed body 425 to alter a volume of air flowing through the inhalation article 10 or to close the air passages 430 so as to prevent loss of flavors included in the additive material.

Figure 9:
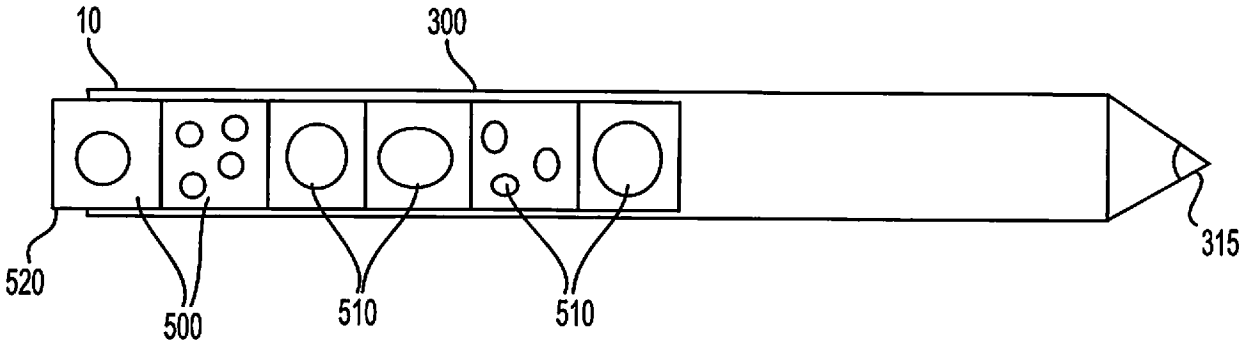
FIG. 9 is a cross-sectional view of a flavor inhalation article according to at least one example embodiment.

FIG. 9 is a cross-sectional view of a flavor inhalation article according to at least one example embodiment.

In at least one example embodiment, the flavor inhalation article 10 may include a plurality of filter segments 500 having at least one flavor bead and/or capsule 510 embedded therein. The plurality of filter segments 500 may be wrapped by a plug wrap 520 or another wrapping, such that the filter segments 500 are held together. The flavor inhalation article 10 may be inserted in the housing 300 as set forth with regards to FIG. 1.

In at least one example embodiment, each of the plurality of filter segments 500 is formed of cellulose acetate tow or another suitable filter material.

In at least one example embodiment, the at least one flavor bead and/or capsule 510 includes an outer shell enclosing an inner core. The inner core and/or the outer shell may contain menthol or other volatile flavors. For example, the inner core can contain mint flavors such as peppermint or spearmint.

In at least one example embodiment, the flavor beads and/or capsules 510 can each have a diameter ranging from about 0.5 mm to about 5 mm (e.g., about 1 mm to about 4 mm or about 2 mm to about 3 mm). The flavor beads and/or capsules 510 can be manufactured and/or include the features of the flavor beads and/or flavor capsules disclosed in U.S. Pat. No. 7,878,962 to Karles et al., which issued Feb. 1, 2011, and U.S. Pat. No. 7,578,298 to Karles et al., which issued Aug. 25, 2009, the entire content of each of which is incorporated herein by this reference thereto.

In at least one example embodiment, the flavor beads and/or capsules 510 are broken to release additives contained therein. The flavor beads and capsules 510 may be broken by squeezing and/or biting the filter segments 500. Thus, an adult consumer may selectively release additives from the flavor beads and/or capsules as desired.

In at least one example embodiment, a crush strength of the flavor beads and/or capsules 510 can vary. The flavor beads and/or capsules have sufficient physical strength to avoid breakage during shipment and/or storage. Moreover, the crush strength of the flavor beads and/or capsules 510 is not so great as to prevent an adult consumer from crushing and/or breaking the flavor bead 510 by squeezing the filter 500.

One or more the flavor beads and/or capsules 510 may be broken to release the additive. An adult consumer may choose to break one or more flavor beads and/or capsules 510 at once or may choose to selectively breaks selected ones of the flavor beads and/or capsules 510 based on choice of additive and/or desired concentration and strength of the additive.

At least one example embodiment relates to a kit including the inhalation article 10 and the oral products 600. The kit may include multiple inhalation articles 10 and multiple oral products 600. The multiple inhalation articles 10 and the multiple oral products 600 may have different flavors. The multiple inhalation articles 10 and the multiple oral products 600 may have varying nicotine levels.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A flavor delivery system comprising:
an oral tobacco product including,
tobacco, and
a first flavorant; and
a flavor inhalation article configured to be utilized concurrently with the oral tobacco product, the flavor inhalation article including,
a body having an air flow channel therethrough, the body including,
a porous substrate, and
a second flavorant.

2. The flavor delivery system of claim 1, wherein the oral tobacco product comprises moist smokeless tobacco, a tobacco tablet, snus, a tobacco matrix, a molded tobacco product, a tobacco bead, a sub-combination thereof, or a combination thereof.

3. The flavor delivery system of claim 1, wherein the oral tobacco product further comprises at least one polymer.

4. The flavor delivery system of claim 1, wherein the oral tobacco product further comprises a coating.

5. The flavor delivery system of claim 1, wherein the oral tobacco product further comprises a binder.

6. A flavor kit comprising:
an oral tobacco product including,
tobacco, and
a first flavorant; and
a flavor inhalation article including,
a body having an air flow channel therethrough, the body including,
a porous substrate, and
a second flavorant.

7. The flavor delivery system of claim 1, wherein the body of the flavor inhalation article comprises at least one plug of filter material and the second flavorant is contained in at least one frangible capsule.

8. The flavor delivery system of claim 7, wherein the at least one plug of filter material comprises cellulose acetate.

9. The flavor delivery system of claim 7, wherein the at least one plug of filter material comprises low efficiency filter material having a resistance-to-draw of about 50 mm $H_2O$ to about 150 mm $H_2O$.

10. The flavor delivery system of claim 1, wherein the flavor inhalation article is an electronic vaping device.

11. The flavor delivery system of claim 10, wherein the electronic vaping device comprises:
a heater; and
a power supply configured to supply power to the heater.

12. The flavor delivery system of claim 1, wherein the flavor inhalation article comprises:
at least one ventilation hole; and
a closing device configured to selectively open the at least one ventilation hole so as to allow air flow through the flavor inhalation article.

13. An oral flavor article comprising:
a housing including,
a first compartment, and
a second compartment;
an oral tobacco product removably contained in the first compartment, the oral tobacco product including,
tobacco, and
a first flavorant; and
a flavor inhalation article configured to be utilized concurrently with the oral tobacco product, the flavor inhalation article at least partially contained in the second compartment, the flavor inhalation article including,
a body having an air flow channel therethrough, and
a second flavorant.

14. The oral flavor article of claim 13, wherein the housing forms part of a writing utensil.

15. The oral flavor article of claim 13, wherein the oral tobacco product comprises moist smokeless tobacco, a tobacco tablet, snus, a tobacco matrix, a molded tobacco product, a tobacco bead, a sub-combination thereof, or a combination thereof.

16. The oral flavor article of claim 13, wherein the oral tobacco product further comprises at least one polymer.

17. The oral flavor article of claim 13, wherein the oral tobacco product further comprises a coating.

18. The oral flavor article of claim 13, wherein the oral tobacco product further comprises a binder.

19. The oral flavor article of claim 13, wherein the body of the flavor inhalation article comprises a porous substrate.

20. The oral flavor article of claim 13, wherein the body of the flavor inhalation article comprises at least one plug of filter material and the second flavorant is contained in at least one frangible capsule.

21. The oral flavor article of claim 20, wherein the at least one plug of filter material comprises cellulose acetate.

22. The oral flavor article of claim 20, wherein the at least one plug of filter material comprises low efficiency filter material having a resistance-to-draw of about 50 mm $H_2O$ to about 150 mm $H_2O$.

23. The oral flavor article of claim 13, wherein the flavor inhalation article is an electronic vaping device.

24. The oral flavor article of claim 23, wherein the electronic vaping device comprises:

a heater; and a power supply configured to supply power to the heater.

25. The oral flavor article of claim 13, wherein the flavor inhalation article comprises:

at least one ventilation hole; and a closing device configured to selectively open the at least one ventilation hole so as to allow air flow through the flavor inhalation article.

26. The kit of claim 1, wherein the flavor inhalation article comprises:

at least one ventilation hole; and a closing device configured to selectively open the at least one ventilation hole so as to allow air flow through the flavor inhalation article.

27. The kit of claim 6, wherein the oral tobacco product comprises moist smokeless tobacco, a tobacco tablet, snus, a tobacco matrix, a molded tobacco product, a tobacco bead, a sub-combination thereof, or a combination thereof.

28. The kit of claim 6, wherein the oral tobacco product further comprises at least one polymer.

29. The kit of claim 6, wherein the oral tobacco product further comprises a coating.

30. The kit of claim 6, wherein the oral tobacco product further comprises a binder.

31. A method of enhancing oral enjoyment of an oral smokeless tobacco product comprising:

pairing a smokeless oral tobacco product with a flavor inhalation article, the flavor inhalation article including, a body having an air flow channel therethrough, the body including, a porous substrate, and a flavorant.

32. The kit of claim 6, wherein the body of the flavor inhalation article comprises at least one plug of filter material and the second flavorant is contained in at least one frangible capsule.

33. The kit of claim 32, wherein the at least one plug of filter material comprises cellulose acetate.

34. The kit of claim 32, wherein the at least one plug of filter material comprises low efficiency filter material having a resistance-to-draw of about 50 mm $H_2O$ to about 150 mm $H_2O$.

35. The kit of claim 6, wherein the flavor inhalation article is an electronic vaping device.

36. The kit of claim 35, wherein the electronic vaping device comprises:

a heater; and a power supply configured to supply power to the heater.

* * * * *